US005226257A

United States Patent [19]

Moss

[11] Patent Number: 5,226,257

[45] Date of Patent: Jul. 13, 1993

[54] GARAGE DOOR SECURITY APPARATUS

[76] Inventor: Richard D. Moss, 9481 Sierra Dr., Arvada, Colo. 80005

[21] Appl. No.: 899,891

[22] Filed: Jun. 17, 1992

[51] Int. Cl.[5] ..... G08B 13/08

[52] U.S. Cl. ..... 49/13; 49/199; 49/263

[58] Field of Search ..... 49/31, 13, 14, 263, 49/264, 25, 199

[56] References Cited

U.S. PATENT DOCUMENTS 4,197,675 4/1980 Kelly ..... 49/31
4,533,905 8/1985 Leivenzon et al. ..... 49/14 X
4,583,081 4/1986 Schmitz ..... 49/14 X
4,665,378 5/1987 Heckethorn ..... 49/31 X
4,937,556 6/1990 Scott et al. ..... 49/31 X

*Primary Examiner*—Philip C. Kannan
*Attorney, Agent, or Firm*—Leon Gilden

[57] ABSTRACT

A control panel includes a first switch to effect selective actuation of a garage door opener motor, with a second on/off switch arranged to effect selective locking engagement and disengagement of the motor relative to the first switch. An indicator light is arranged to indicate separation of a garage door from a garage door framework. An abutment switch is arranged also for engagement with a vehicular windshield for actuation of the garage door motor.

2 Claims, 4 Drawing Sheets

GARAGE DOOR SECURITY APPARATUS

BACKGROUND OF THE INVENTION

1. Field of the Invention

The field of invention relates to garage door apparatus, and more particularly pertains to a new and improved garage door security apparatus wherein the same is arranged to provide for selective actuation of a garage door and selective deactuation of the door to prevent its opening.

2. Description of the Prior Art

Garage door security apparatus of various types is utilized throughout the prior art, and typically of a complex and elaborate construction, as illustrated and discussed in the U.S. Pat. Nos. 4,464,651 and 4,433,274.

U.S. Pat. No. 4,922,166 sets forth a door safety system to determined garage door movement, as well as an obstruction to a garage door closing.

U.S. Pat. Nos. 4,668,899 and 4,794,732 as illustrative of typical garage door constructions relative to an associated framework.

As such, it may be appreciated that there continues to be a need for a new and improved garage door security apparatus as set forth by the instant invention which addresses both the problems of ease of use as well as effectiveness in construction in a manner not addressed by the prior art and in this respect, the present invention substantially fulfills this need.

SUMMARY OF THE INVENTION

In view of the foregoing disadvantages inherent in the known types of garage door apparatus now present in the prior art, the present invention provides a garage door security apparatus wherein the same is arranged for the selective deactuation of a garage door drive motor. As such, the general purpose of the present invention, which will be described subsequently in greater detail, is to provide a new and improved garage door security apparatus which has all the advantages of the prior art garage door apparatus and none of the disadvantages.

To attain this, the present invention provides a control panel including a first switch to effect selective actuation of a garage door opener motor, with a second on/off switch arranged to effect selective locking engagement and disengagement of the motor relative to the first switch. An indicator light is arranged to indicate separation of a garage door from a garage door framework. An abutment switch is arranged also for engagement with a vehicular windshield for actuation of the garage door motor.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical discloser of the application. The abstract is neither intended to define the invention of the application, which is measured by the claims, nor is it intended to be limiting as to the scope of the invention in any way.

It is therefore an object of the present invention to provide a new and improved garage door security apparatus which has all the advantages of the prior art garage door apparatus and none of the disadvantages.

It is another object of the present invention to provide a new and improved garage door security apparatus which may be easily and efficiently manufactured and marketed.

It is a further object of the present invention to provide a new and improved garage door security apparatus which is of a durable and reliable construction.

An even further object of the present invention is to provide a new and improved garage door security apparatus which is susceptible of a low cost of manufacture with regard to both materials and labor, and which accordingly is then susceptible of low prices of sale to the consuming public, thereby making such garage door security apparatus economically available to the buying public.

Still yet another object of the present invention is to provide a new and improved garage door security apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
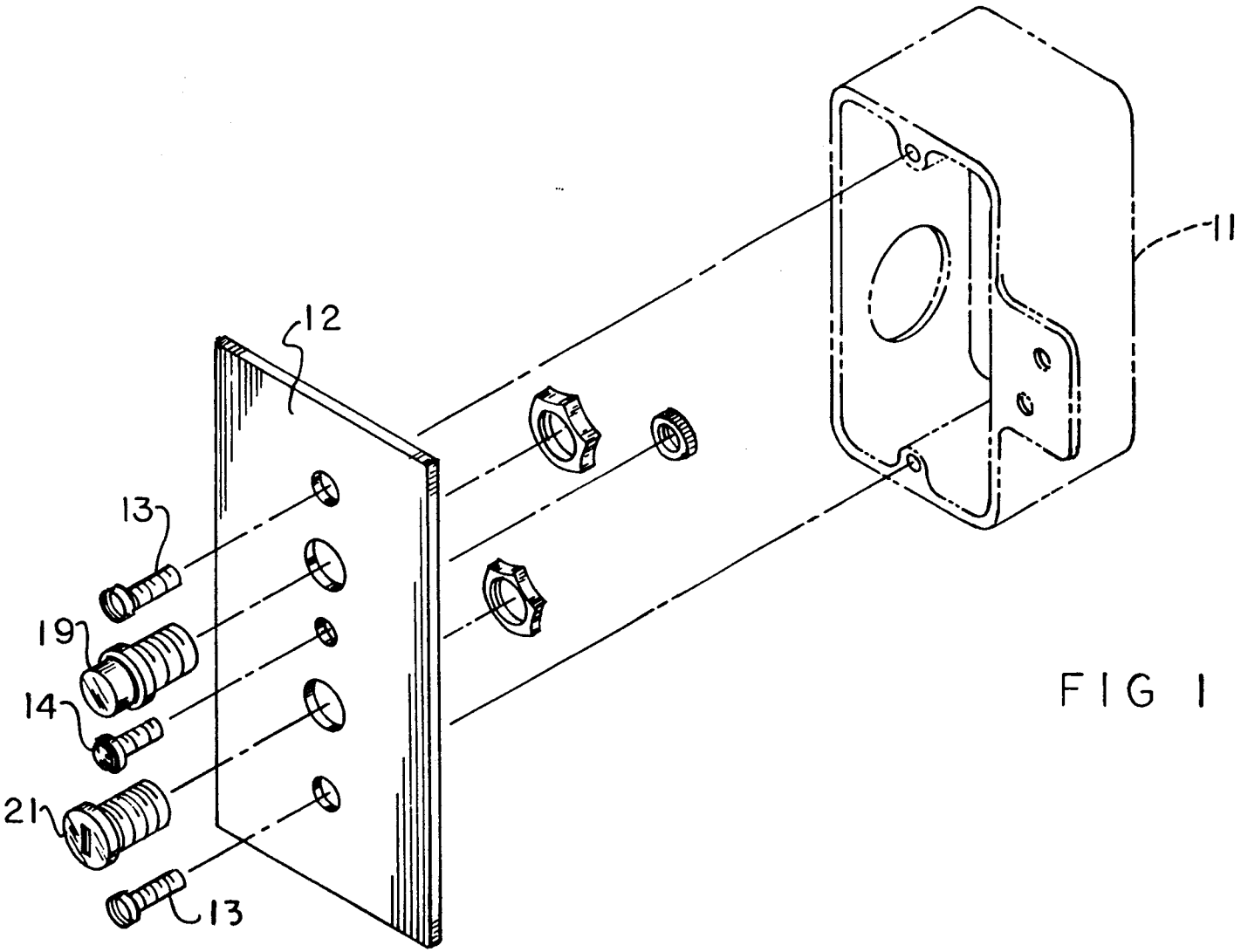
FIG. 1 is an isometric illustration of the mounting plate and actuator switches of the invention.

With reference now to the drawings, and in particular to FIGS. 1 to 7 thereof, a new and improved garage door security apparatus embodying the principles and concepts of the present invention and generally designated by the reference numerals 11-41 will be described.

Figures 3A, 5:
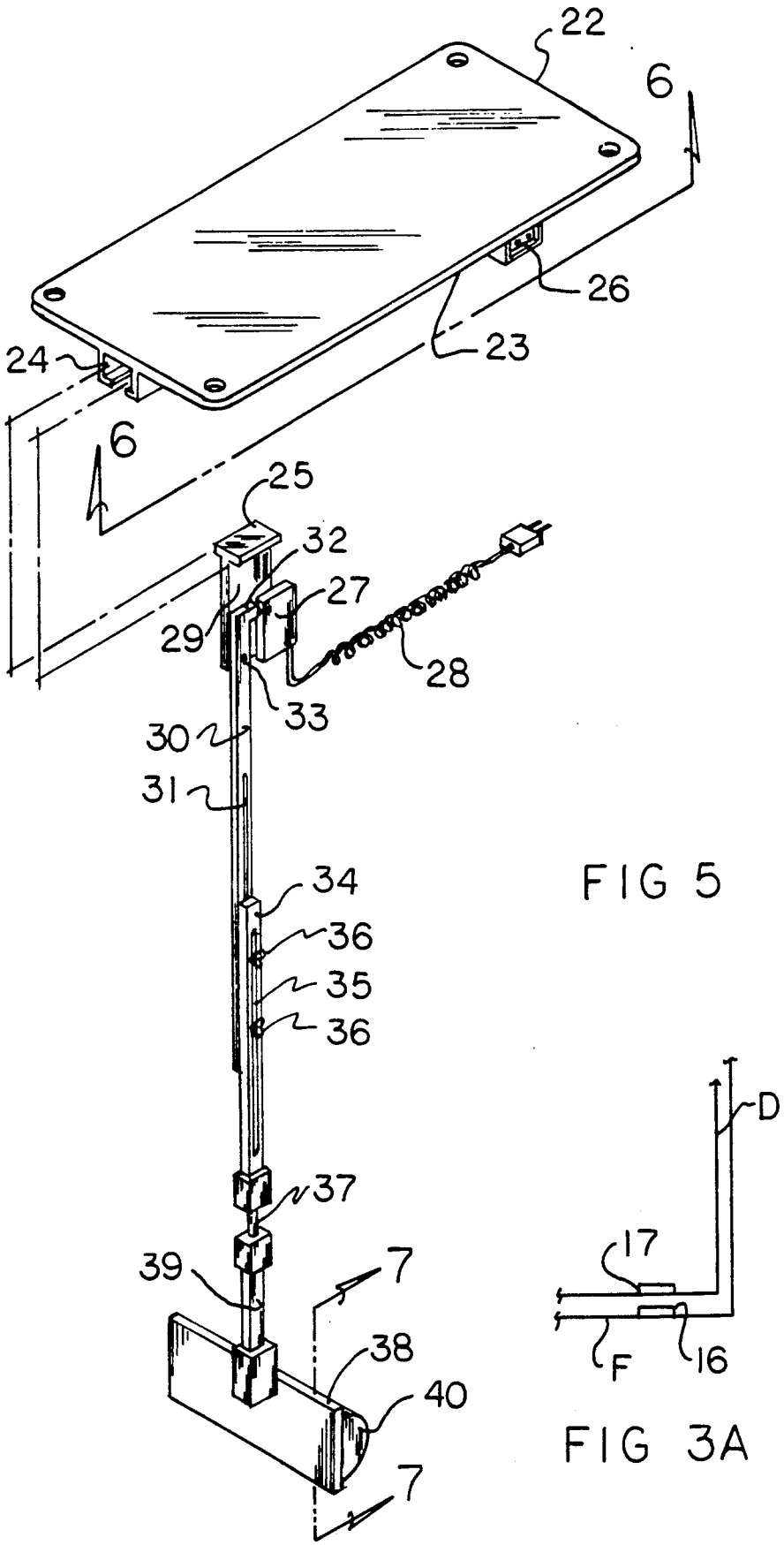
FIG. 3*a* is an orthographic view of the magnetic switch structure mounted relative to a garage door and associated framework.
FIG. 5 is an isometric illustration in an exploded view of a windshield striker utilized by the invention.

More specifically, the garage door security apparatus of the instant invention essentially comprises an electrical outlet housing 11 mounted within a house of typical construction (not shown) having a mounting plate 12, with mounting plate fasteners 13 securing the mounting plate to the housing 11. The mounting plate 12 includes indicator light 14 directed medially of the mounting plate cooperative with a transformer electrical supply 15 to effect illumination of the indicator light 14 upon a magnetic switch first contact 16 separating from a magnetic switch second contact 17, in a manner as illustrated in FIG. 5 relative to garage door "D" separating from a door framework "F".

Figure 2:
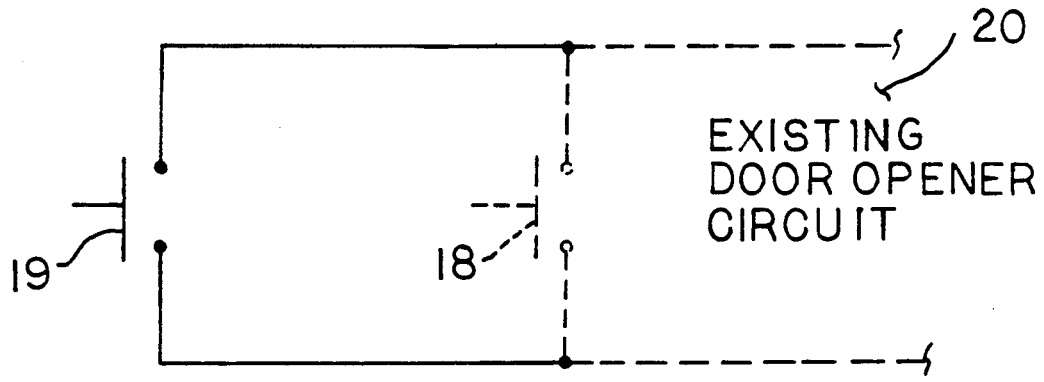
FIG. 2 is a diagrammatic illustration of the actuator switch as utilized by the invention in association with an existing garage door actuator button.
Figure 3:
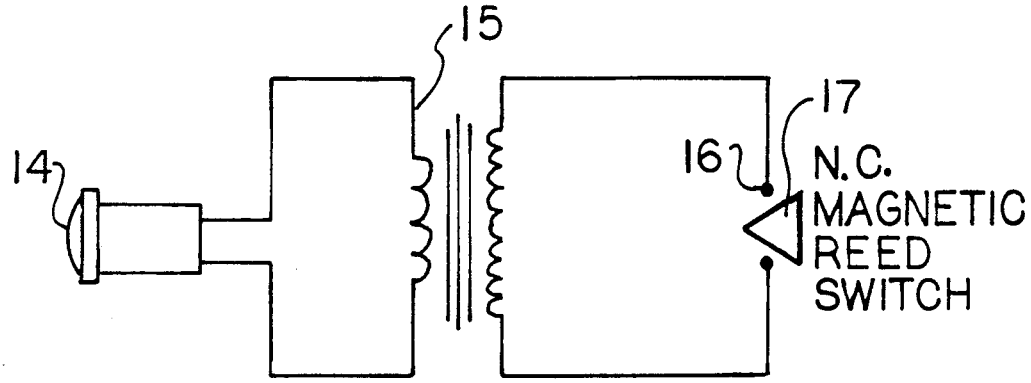
FIG. 3 is a diagrammatic illustration of the indicator light structure.
Figure 4:
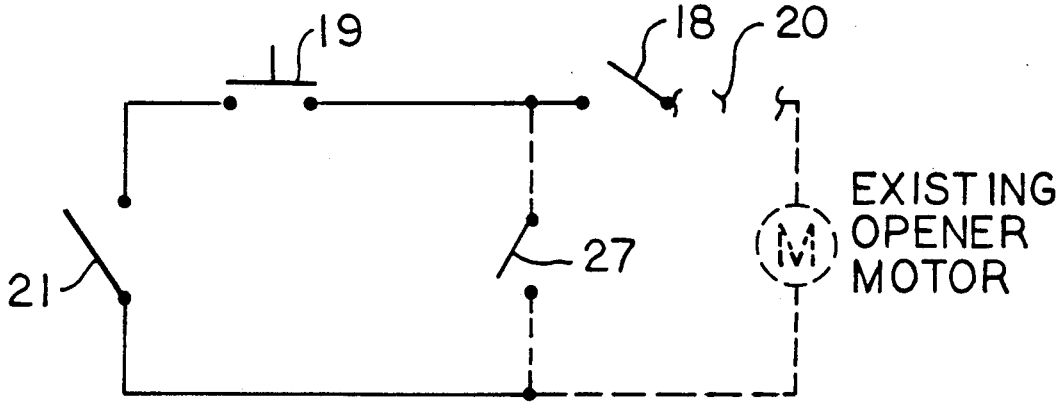
FIG. 4 is a diagrammatic illustration of the switch structure utilized by the invention.

The FIG. 2 illustrates that the organization is arranged for cooperation with an existing door opener circuitry 20 operative through a garage door opener first switch 18. The organization of the invention includes a garage door opener second switch 19 operative to effect actuation and energizing of the existing door opener circuit 20 in lieu of the first switch 18. Further, an on/off lock switch 21 is provided to permit deactivating of the circuit, to include the second switch 19, as well as the first switch 18.

Figure 6:
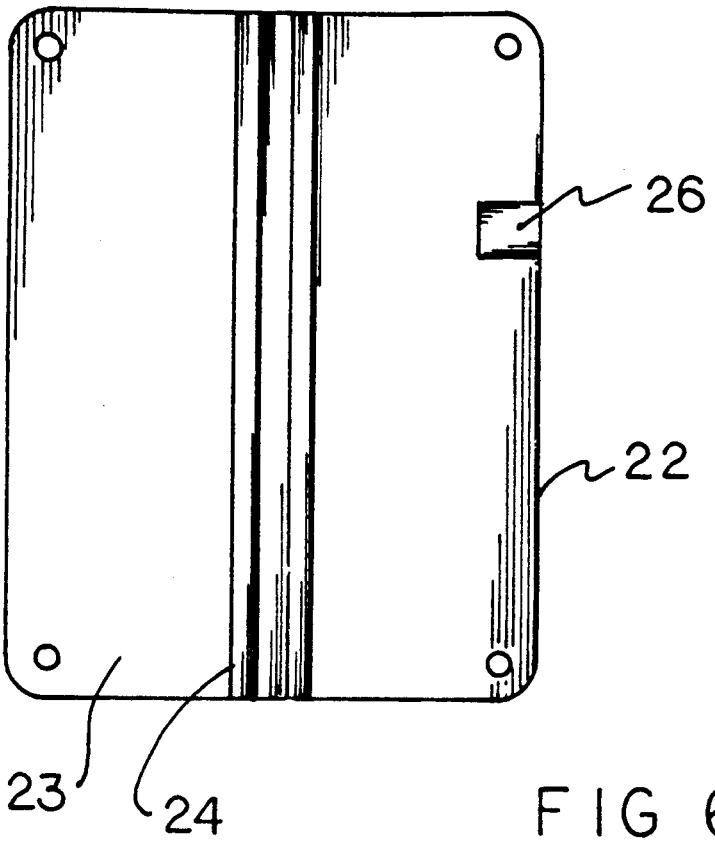
FIG. 6 is an orthographic view, taken along the lines 6—6 of FIG. 5 in the direction indicated by the arrows.
Figure 7:
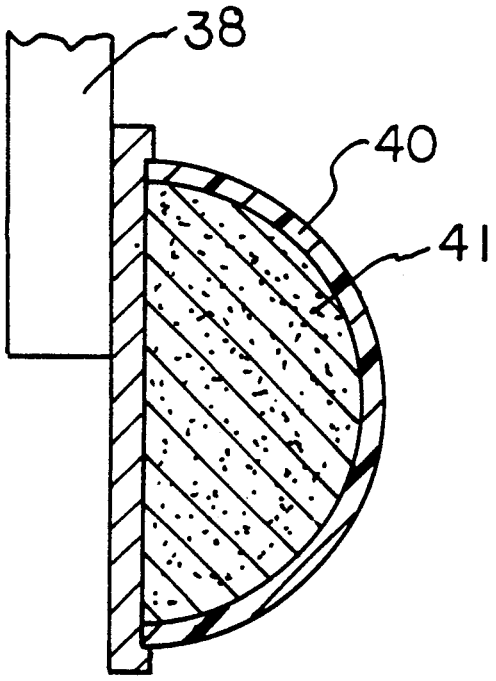
FIG. 7 is an orthographic view, taken along the lines 7—7 of FIG. 5 in the direction indicated by the arrows.

Additionally, the organization is arranged to further include if desired a windshield impact switch structure to effect closure of the garage door and actuation of the associated garage door motor upon contacting of the contact switch structure, as indicated in FIG. 6. A mounting plate 22 is provided for mounting to a ceiling structure of an associated garage having a first surface 23, including a guide track 24 longitudinally of the mounting plate 22. The guide track 24 includes a follower flange 25 received slidably therewithin, as well as an electrical socket 26 in electrical communication with the existing garage door opener "M" to effect closure of an existing garage door in actuation of the drive motor in that manner. A striker switch member 27 is mounted to a follower flange support flange 29 projecting orthogonally and downwardly below the follower flange 25, wherein the striker switch member 27 includes an electrical power cord 28 for electrical communication with the electrical socket 26. A pivot arm 30 is pivotally mounted about a pivot arm axle 33 to the follower flange support flange 29 that includes a pivot arm slot 31 to slidably and vertically accommodate in an adjustable manner a striker arm 34 that includes a striker arm slot 35 utilizing fasteners 36 to secure the striker arm 34 and the pivot arm together in a longitudinally aligned relationship. A pivot arm actuator projection 32 mounted to an upper end of the pivot arm 30 is arranged for engagement with the striker switch member 27. The striker arm 30 includes a frangible link 37 at a lower end thereof mounting a contact head arm 39, wherein the frangible link 37 is ruptured upon sudden impact thereto by a vehicle to prevent unnecessary damage to the vehicular windshield. The contact head arm 39 includes a contact head plate 38 mounted to a lower end of the contact head arm 39 that is arranged generally parallel to the pivot arm 30 and the striker arm 34. It should be noted that a frangible link 37, as well as the contact arm 39 and the pivot arm 30 and the striker arm 34, are arranged in a longitudinally aligned relationship as indicated in the FIG. 5. The contact head plate 38 includes an abutment cushion 40 mounted to a forward surface thereof for accommodation with a vehicular windshield having a compressible gel 41 (see FIG. 7) contained therewithin to avoid marring and impact to a vehicular windshield in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garage door security apparatus, comprising, a reversible electric garage door drive motor, and a first switch arranged for selective actuation of the garage door drive motor, and a mounting plate, the mounting plate having a second switch, the second switch arranged for selective actuation of the garage door drive motor, and a third on/off switch, including a lock member to effect selective deactivation of the first switch and the second switch, and an indicator light mounted in the mounting plate, including an electrical supply to effect selective actuation of the indicator light, and a garage door, the garage door having a garage door peripheral edge and a garage door framework, with the garage door peripheral edge including a magnetic switch first segment and the garaged door framework including a cooperative garage magnetic switch second segment, wherein the magnetic first segment and the magnetic second segment are arranged for activation of the indicator light upon separation of the magnetic first switch relative to the magnetic second switch, and the mounting plate including a guide track, the guide track slidably receiving a follower flange, the follower flange having a follower flange support flange orthogonally directed below the follower flange, with the follower flange support flange including a striker switch member mounted thereon, the striker switch member arranged in electrical communication with the drive motor for actuation of the drive motor upon closure of the striker switch member.

2. An apparatus as set forth in claim 1 wherein the follower flange support flange includes a pivot arm pivotally mounted about a pivot axle, with the pivot axle directed into the follower flange support flange and the pivot arm including a pivot arm projection at an upper end of the pivot arm arranged in adjacency relative to the striker switch member to effect closure of the striker switch member upon pivotment of the pivot arm about the pivot arm axle, the pivot arm including a pivot arm slot longitudinally aligned with the pivot arm directed therethrough, and a striker arm, the striker arm mounted to the pivot arm, the striker arm including a striker arm slot, and a plurality of fasteners directed through the striker arm slot and the pivot arm slot to secure the striker arm to the pivot arm, and the striker arm and the pivot arm arranged in a longitudinally aligned relationship, and the striker arm including a striker arm lower distal end, the striker arm lower distal end including a frangible link, the frangible link including a contact head plate mounted to a lower distal end of the frangible link spaced from the striker arm, and the plate including an abutment cushion arranged for engagement with a vehicular windshield, with the abutment cushion including a compressible gel contained therewithin.

* * * * *